United States Patent [19]

Barker et al.

[11] Patent Number: 4,671,356

[45] Date of Patent: Jun. 9, 1987

[54] THROUGH TUBING BRIDGE PLUG AND METHOD OF INSTALLATION

[75] Inventors: James M. Barker, Katy; Harold V. Bratt, Houston, both of Tex.

[73] Assignee: Halliburton Company, Duncan, Okla.

[21] Appl. No.: 846,404

[22] Filed: Mar. 31, 1986

[51] Int. Cl.[4] ..... E21B 33/134

[52] U.S. Cl. ..... 166/285; 166/133; 166/386

[58] Field of Search ..... 166/285, 386, 387, 69, 166/117, 123, 133–135, 188, 192, 202

[56] References Cited

U.S. PATENT DOCUMENTS

| | | | |
|---|---|---|---|
| 2,489,216 | 1/1970 | Armstrong et al. | 166/135 |
| 3,064,734 | 11/1962 | Toelke | 166/202 |
| 3,282,347 | 11/1966 | Chenoweth | 166/202 |
| 3,460,624 | 8/1969 | Aitken et al. | 166/387 |
| 3,891,034 | 6/1975 | Owen et al. | 166/285 |

*Primary Examiner*—James A. Leppink
*Assistant Examiner*—Hoang C. Dang
*Attorney, Agent, or Firm*—W. J. Beard

[57] ABSTRACT

A through tubing bridge plug is disclosed. In the preferred and illustrated embodiment, a central hollow tube having a passage therein supports the external parts. The central passage terminates top and bottom with openings or passages. At the top end, a sleeve valve mechanism originally pinned in an open position is installed. When the installation is completed, the sleeve valve is closed by a sequence of operations to permanently close the flow path. The device is set and anchored by applying a relative downward force to an external sleeve thereby deploying slips to lock the device in location, additionally deploying an upwardly facing petal basket to receive a charge of sand and cement to form a plug, and also deploying a centralizer. The device is installed at a specified elevation by anchoring slips to prevent movement, deploying the petal basket to hold sand and cement for curing, locating the device in the casing by a centralizer, and bypassing fluid around the curing sand and cement through central tubing opening below and above the uncured materials. The final step includes closing a sleeve valve to prevent further flow through the device.

17 Claims, 10 Drawing Figures

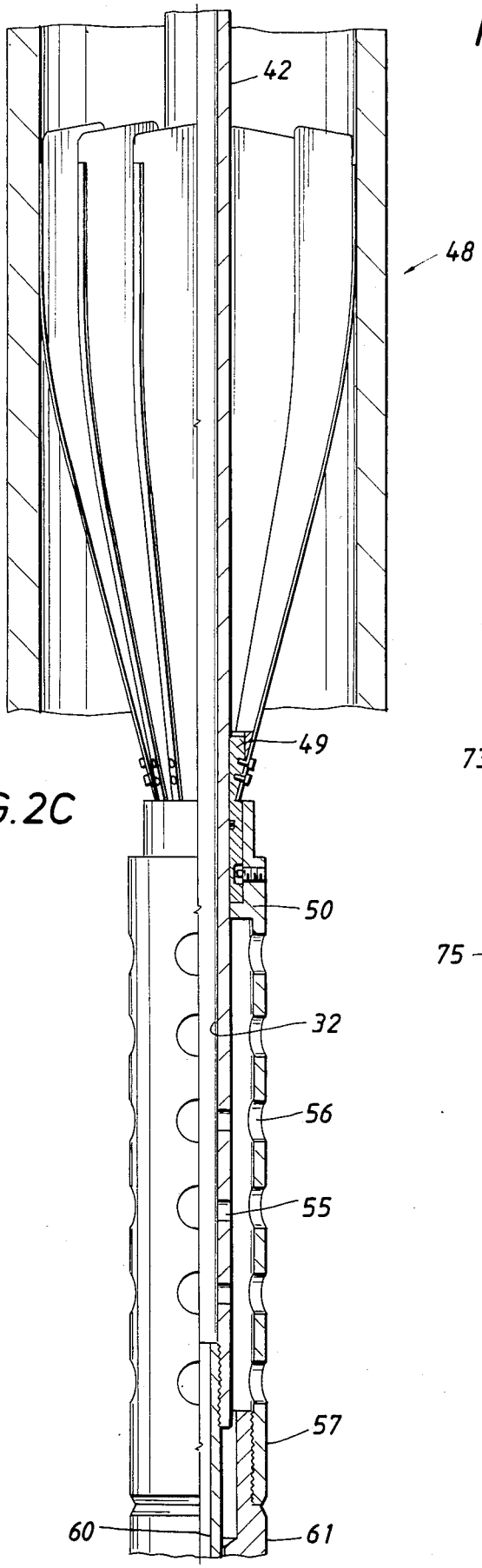
FIG. 2C
FIG. 2D
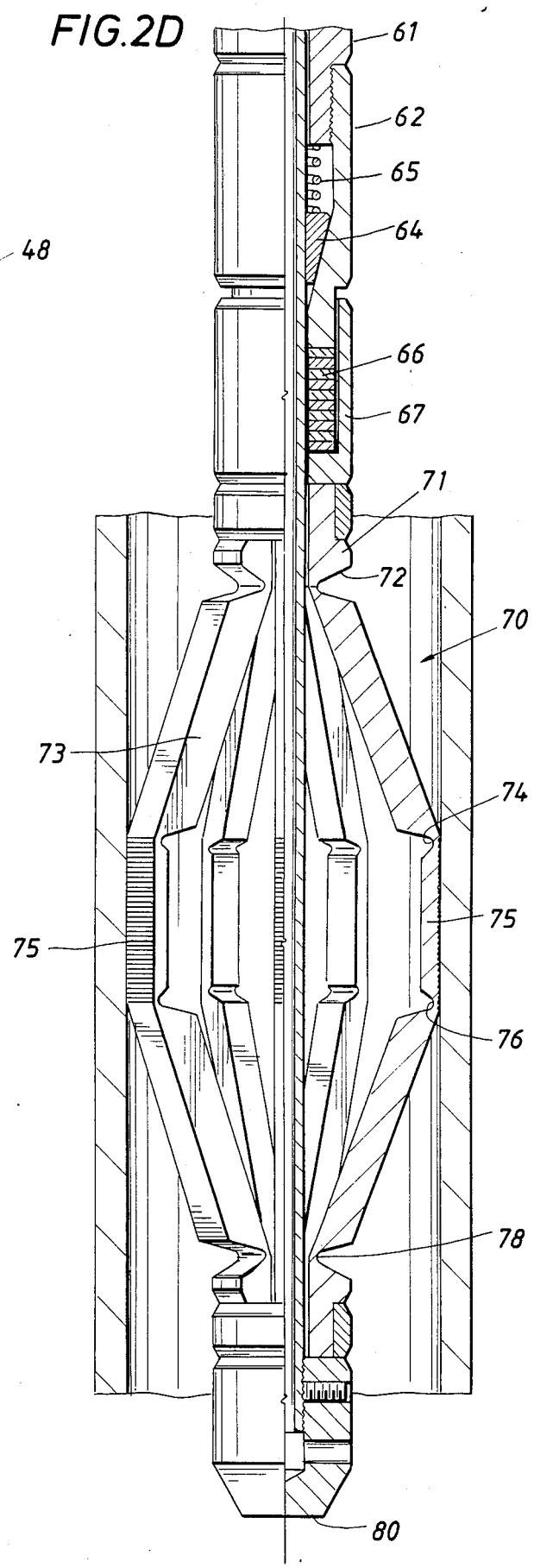

THROUGH TUBING BRIDGE PLUG AND METHOD OF INSTALLATION

BACKGROUND OF THE DISCLOSURE

This disclosure is directed to a through tubing bridge plug adapted to set in a cased well even in the presence of formation fluids which might otherwise contaminate the cement plug supported by the bridge plug. For various reasons, it is often necessary to place a bridge plug in a completed well even though there may be production of formation fluids in the vicinity.

As an example, consider a well that is producing exoessive amounts of water from a depleted oil or gas zone. It may be beneficial to set a plug above this depleted zone and produce from a more desirable upper zone. Assume also that the upper and lower zones may freely exchange fluids through perforations in the casing.

At this juncture, it is difficult to form a cured concrete plug with assurance of quality in view of the fact that the migrating fluids may contaminate the plug materials prior to setting and thereby damage the plug.

The present apparatus and procedure overcome this limitation. This enables a bridge plug to be set at a specified depth in a well notwithstanding the presence of migrating fluids in the well which might otherwise cause contamination. The present through tubing bridge plug can be anchored at a selected depth in a well and is held in position by expandable slips engaging the casing. The device has a petal basket which is deployed facing upwardly to receive sand and cement dumped by a bailer. There is a centrally located tubing which extends substantially well above the finished plug. Through a suitable valving arrangement (cooperative with fishing neck supported components) the plug is set in the casing while fluid is conducted through the through tubing. This bypasses the area where sand and cement is located. Thus, the through tubing and associated valving is selectively opened at the proper time, closed thereafter, and a fishing neck is retrieved to provide an indication external of the well that the valve closing sequence has been completed.

This arrangement thus enables the through tubing to divert fluid away from the uncured sand and cement. After curing, the bypass fluid can then be shut off by operation of the valve with a suitable overshot. This enables addition of sand and cement above the cured plug, thereby closing the well to additional flow permanently. When completed, the bridge plug is then underneath the concrete plug, the through tubing which was otherwise open is closed and covered over with the second pour which completes the concrete plug. Moreover, one of the components of the apparatus is selectively retrieved. Retrieval indicates proper setting and operation. Important additional features include an arrangement whereby torque applied to the bridge plug typically during makeup is not transmitted to the petal basket thereby avoiding twisting individual petal leaves. This prevents warpage of the petal basket upon deployment.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIGS. 1A–1D and 2A–2D are lengthwise sectional views of the through tubing bridge plug of the present disclosure showing the contrast between the running condition of FIGS. 1A–1D and the set condition of FIGS. 2A–2D wherein slips and centralizers deployed to position an upwardly open petal basket for receiving sand and cement to form a plug.

DETAILED DESCRIPTION OF THE PREFERRED EMBODIMENT

Figure 1A:
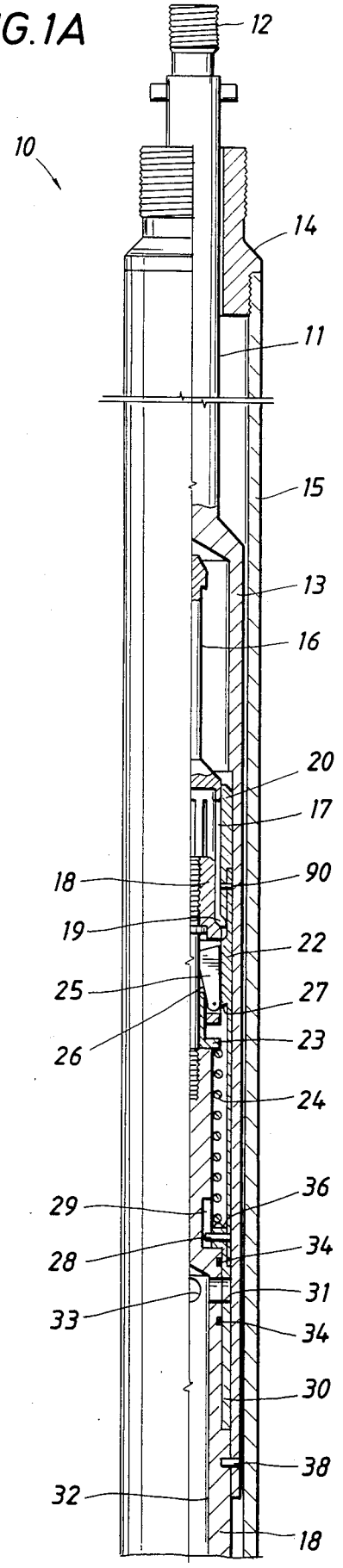
Figure 1B:
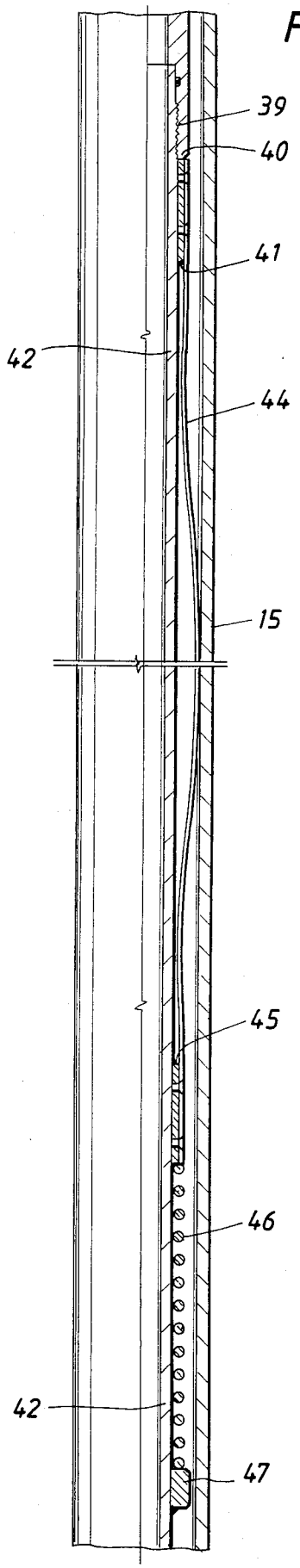
Figure 1C:
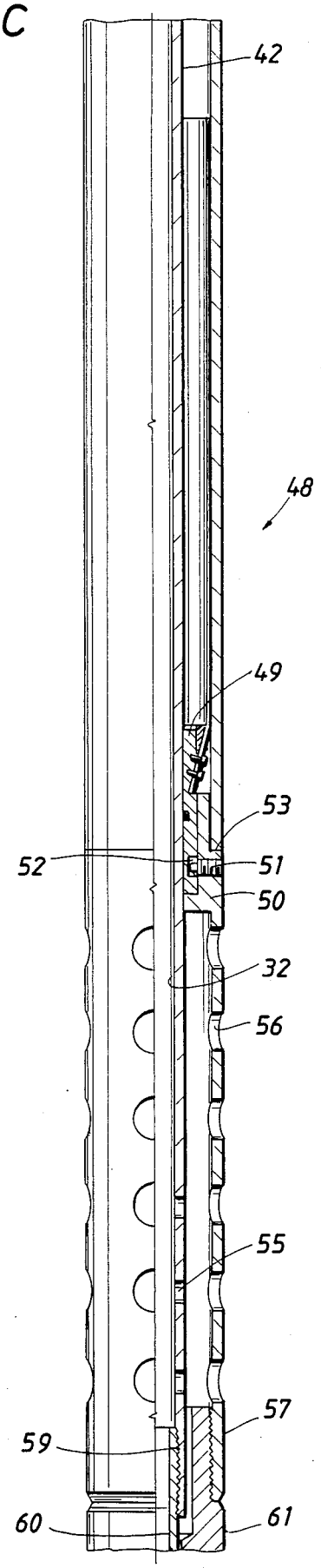
Figure 1D:
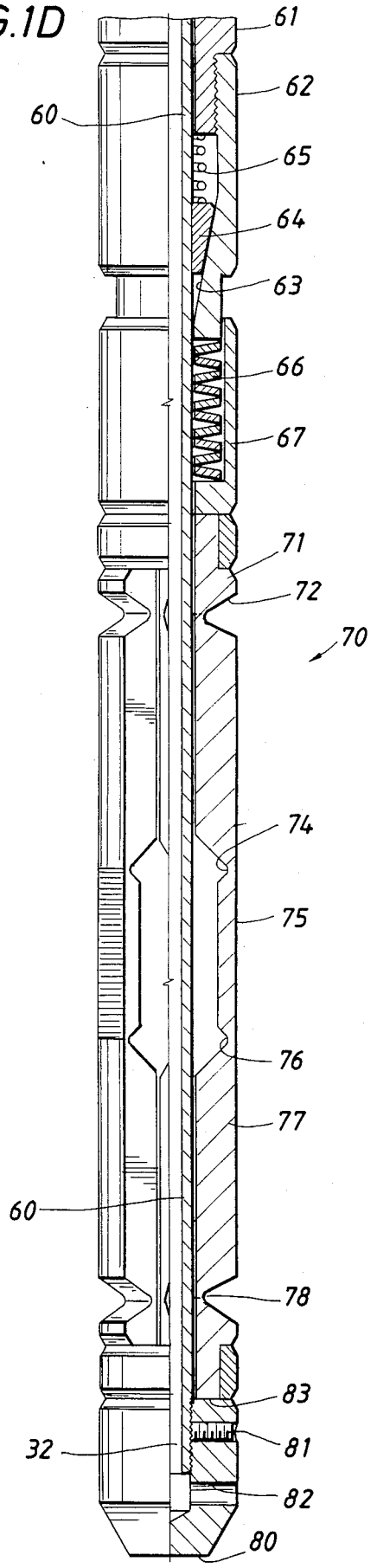
Figure 2A:
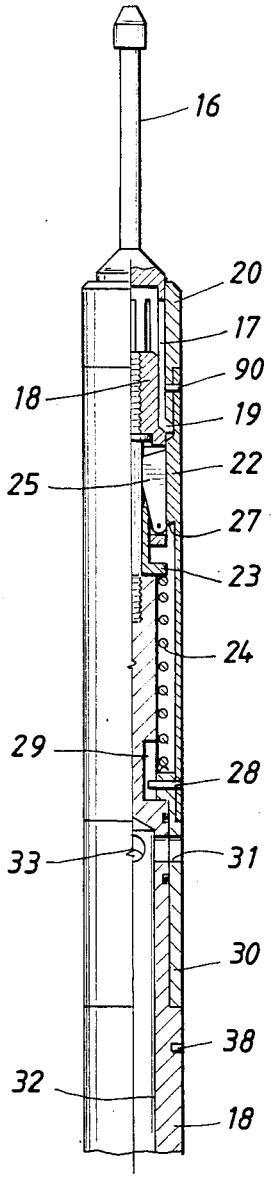
Figure 2B:
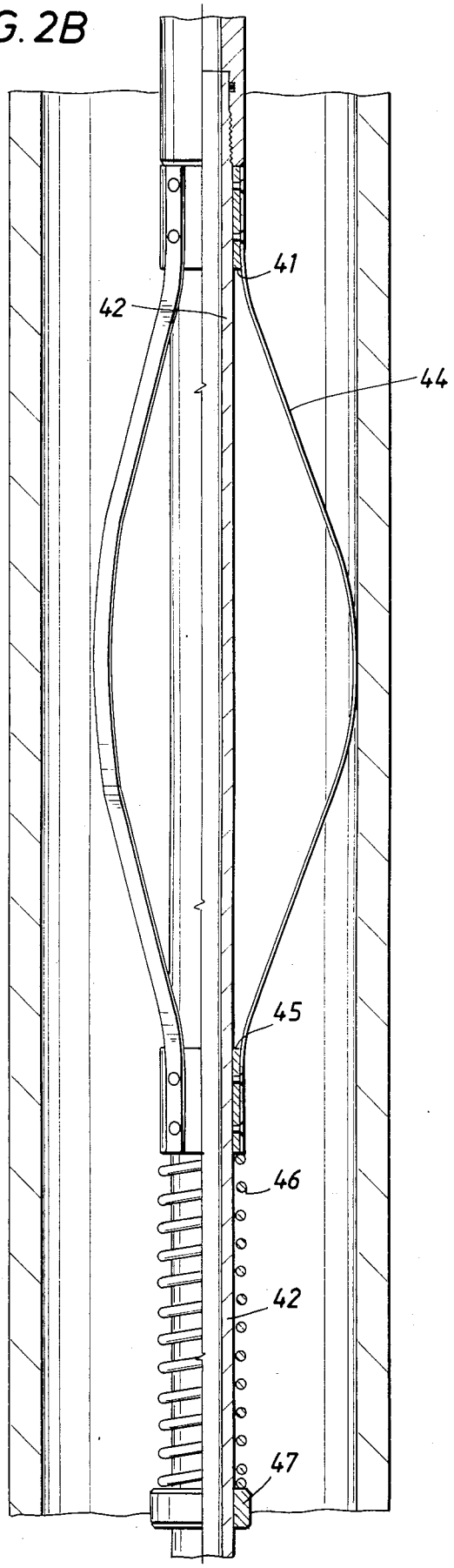

The through tubing bridge plug (TTBP hereinafter) is identified generally by the numeral 10 in FIGS. 1 and 2. It is shown in the running condition in FIG. 1. FIG. 2 is a contrast showing the device after certain setting operations have occurred. Thus, the description of the TTBP will proceed from the top end of the tool in FIG. 1 to the bottom end. At times, the apparatus will be more readily understood by reference to FIG. 2, but primarily the description is directed to the structure as shown in FIG. 1. The alternative positions of the components after movement will be more readily understood by contrasting FIGS. 1 and 2 with one another. In a few instances, and particularly referring to the upper end of the apparatus, FIG. 3 will be referred to. This relates to the valving action which is accomplished at the upper end of the device.

Beginning at the upper end of the device, there is a central mandrel 11 which is equipped with a threaded neck 12 at the upper end. It is affixed to a running tool (not shown). A typical running tool is the wireline pressure setting assembly, model 05 of Baker. This type running tool employs a gas generating powder charge to create relative motion between outer and inner mandrels. Attachment is accomplished by threading to the running tool at the threads 12. The central mandrel 11 is a solid, rod like member as shown in the upper portions of FIG. 1. It then terminates to form an elongate sleeve 13. The sleeve 13 is internally hollow to enclose certain apparatus to be described. Separately, a collar 14 is positioned around the mandrel for telescoping movement thereon. The collar 14 is attached at its upper end by threaded engagement to the wireline pressure setting assembly. The lower end of the collar is threaded to a larger diameter, axially hollow sleeve 15. The sleeves 13 and 15 are concentric to one another. The sleeve 13 is relatively short in contrast with the sleeve 15. The sleeve 15 is quite long, enclosing certain centralizer components as will be described hereinafter.

In operation, a sequence of operations is conducted whereby the sleeves 13 and 15 are pulled upwardly. The sleeve 15, being much longer, is pulled upwardly to enable deployment of a centralizer to be described. The sleeve 13 is pulled upwardly and removed to expose a fishing neck. The operative steps relating to this sequence of operations will be described in detail hereinafter. The sleeves 13 and 15 thus enable the equipment to be run into the cased well to any depth prior to setting. The sleeves 13 and 15 are important to operation of the device; the sequence in which they are removed triggers certain operational steps.

The TTBP carries an upwardly directed fishing neck 16 which is temporarily housed within the sleeve 13. The fishing neck will later be separated from the remainder of the equipment. To this end, the fishing neck 16 connects with a set of collet fingers 17. The collet fingers are forced radially outwardly by a plug 18 positioned in the collet fingers which have a surrounding bottom peripheral enlargement 19 which locks adjacent an internal upset shoulder on a locking sleeve 20. The sleeve 20 is sized to surround the fishing neck. The fishing neck is thus held in the illustrated location of FIG. 1 by the enlargement 19. The enlargement 19 abuts against the shoulder and is held in this position so long as the plug 18 is in the position shown in FIG. 1. The plug 18 will later be pulled relatively downwardly to enable the enlargement 19 to deflect radially inwardly, thereby enabling the collet fingers to deflect inwardly for retrieval of the fishing neck 16. In the event the plug 18 will not move (due to cement contamination), a set of shear pins 90 will shear allowing the fishing neck 16 and sleeve 20 to release.

The sleeve 20 is pinned to a continuing sleeve 22 by the shear pins 90. The sleeve 22 has an internal portion (somewhat thicker) to define a cooperative shoulder surrounding the enlargement 19 as shown in FIG. 1. The sleeve 22 encloses a spring driven, setting wedge cooperative with a set of dogs. Considering this in greater detail, the plug 18 supports a cylindrical wedge 23, the wedge being rested against an upwardly facing shoulder on the plug. A spring 24 forces the wedge upwardly. The spring is shown in the relaxed condition in FIG. 1 to be contrasted with the compressed condition of FIG. 3. The wedge 23 includes an upstanding tapered skirt which contacts several pivoted dogs 25. The several dogs are mounted in slotted windows 26 that are an integral part of the plug 18. The dogs are tapered as shown in FIG. 1, having an inside face which is operatively contacted by the wedge 23. This enables the dogs to be driven outwardly. In FIG. 1, the wedges are retracted. They are clamped in position by the surrounding sleeve 22. This is the position sustained during running in the well. The surrounding sleeve 22 holds the dogs radially inwardly as shown in FIG. 1. The dogs 25 thus pivot around pins driven through the slotted windows 26. In a typical installation, three or four dogs will suffice to obtain locking. The dogs include an outer face ending at a sharp upper corner. This upper corner locks against a shoulder 27 on the interior of the sleeve 22. As shown in FIG. 1, the dogs are in a collapsed position away from the shoulder 27. The dogs must be moved relatively downwardly to enable the dogs to move outwardly under action of the tapered wedge 23. This movement is prevented by a shear pin 28. The pin 28 joins the outer sleeve 22 to the apparatus on the interior of that sleeve. The shear pin 28 is fixedly held in a drilled hole accommodating the shear pin pressed into the sleeve 22. The opposite end of the shear pin is received in a lengthwise slot 29 formed in the plug 18. It will be observed that the plug is made of multiple components for ease of manufacture, the plug nevertheless being slotted at 29. The slot has a finite length to enable some movement before shearing the pin 28. This range of movement is important during setting of the tool to accommodate elongation and subsequent recoil of the components. The range of movement prevents premature shear of the pin 28 during the setting process.

The sleeve 22 is joined by the shear pin 28 to a valve sleeve 30. The valve sleeve 30 is formed with one or more valve ports 31. The valve sleeve 30 fits around the plug 18, the elongate plug being somewhat larger in diameter to enclose an internal passage 32. The passage 32 extends along the length of the plug 18 below a lateral port 33 which is aligned with the valve port 31. These ports define a flow path which extends to the very bottom of the apparatus 10 to bypass centralizers, the petal basket, and setting slips therebelow, all as will be described. Communication between the valve ports 31 and 33 is sealed by flanking O-ring seals 34. The seals above and below the two ports just mentioned assure a fluid flow path in the position shown in FIG. 1 to block that flow path when the valve sleeve 30 is moved upwardly (see FIG. 3). The valve sleeve 30 has an upper shoulder 36 which abuts the coil spring 24 shown relaxed in FIG. 1. By contrast, it is compressed in FIG. 3 to assure that the wedge 23 drives under the dogs 25, thereby deflecting them radially outwardly into the locking position against the shoulder 27.

After the sleeves 13 and 15 which surround the sleeve valve mechanism just described are removed, the port 31 is exposed and thereby open. In the running position shown in FIG. 1, the port 31 is covered by the sleeves. This flow path through the port 31 is opened controllably after installation of the TTBP 10. As a subsequent step, the valve is closed by moving the valve sleeve 30 upwardly to close the port 31 (see FIG. 3). This setting movement is prevented by a pin 38 which must be sheared in a particular sequence in conjunction with the shear pin 38. This operation will be described in detail hereinafter.

As stated earlier, the plug 18 is assembled from several components for ease of manufacture. The components are threaded together to define the plug 18. At this juncture, it is perhaps better to note that the plug is now axially hollow, enclosing the passage 32. As mentioned earlier, the plug is made of relatively thick walled tubular members joining at the threaded connection 39. This defines a downwardly facing shoulder 40 which abuts a sleeve 41 around a central tube 42. The tube 42 extends the passage 32 towards the lower portion of the apparatus as will be described. The sleeve 41 anchors the upper end of several centralizer wires 44. The centralizer wires are anchored at the upper end to enable them to deflect outwardly in a bow shape as shown in the contrast between FIGS. 1 and 2. Recall that the structure shown in FIG. 1 prior to setting. It is run into the well with the sleeve 15 capturing the centralizer wires. They are clamped inwardly against deflection. The centralizer wires 44 are anchored at the upper end at the surrounding sleeve 41 and are secured at the lower end with a similar sleeve 45. The centralizer sleeves 41 and 45 slide on the tube 42. A compressed coil spring 46 forces the centralizer upwardly, thereby creating bowing deflection of the wires. This bowing is forbidden during running of the tool 10. The spring 46 is shown compressed in FIG. 1. It shoulders against a ring 47 around the tube 42. All of these components are initially surrounded by the release sleeve 15 as shown in FIG. 1. By contrast, the spring 46 is elongated in FIG. 2 when the centralizer is released for deployment.

The tube 42 supports a closed set of petal leaves indicated generally at 48. This comprises the petal basket. It is constructed with a circular wedge 49 affixed to a collar 50. The collar 50 is joined by a screw 51 which extends into a slot 52. The slot is in the form of a groove fully encircling the wedge 49 thereby enabling the wedge to rotate relative to member 57 which will be described later. Axial movement is thus forbidden but rotational movement is permitted. This is important in operation to prevent twisting of the collapsed, or folded, petal leaves bv rotation during assembly inside the sleeve 15. As will be understood, the petal basket is made up of several thin metal leaves which are constricted in FIG. 1 by the surrounding sleeve 15. This sleeve extends over the petal basket to abut the shoulder 53. When the sleeve 15 is pulled upwardly, it moves away from the petal leaves permitting them to deflect outwardly. They are made of spring metal to deploy into the basket shown in FIG. 2. They deflect outwardly until they engage the surrounding well casing.

Continuing on down the TTBP 10, the tube 42 is perforated with several holes at 55. These holes align adjacent to similar holes 56 in a surrounding sleeve 57 constructed integral with the ring 50 at the bottom of the petal basket.

To review to this juncture, the central tube 42 which encloses the passage 32 is able to move relative to the surrounding tubular member 57 connected with the bottom of the petal basket. This telescoping movement between the two components has value in setting the tool for operation as will be described. The central tube 42 is conveniently terminated by threads at 59 to join an extension tube 60. This tube continues the passage to lower parts of the TTBP 10. On the exterior, the tubular member 57 connects with a coupling 61. This coupling is a slip retainer ring threadedly joined to a slip cage 62. The slip cage is constructed with an internal tapered slip surface 63. A tapered or wedged shaped slip member 64 is positioned against the tapered surface 63 and is able to move upwardly and downwardly against that surface at the urging of a spring 65. In turn, the tapered slip member 64 slides on the exterior of the extension tube 60. Suitable rough surfaces having the preferred form of serrations are included so that the spring 65 may expand, forcing the wedge shaped ring 64 downwardly and locking the slip cage 62 downwardly on the extension tube 60.

The slip cage is shown in FIG. 1 above a stack of alternating Belleville washers. They form a compressible spring which is extended in FIG. 1. The washers 66 are surrounded by a sleeve 67 which serves as a spring housing around the Belleville washers 66. All of the apparatus on the exterior of the tube 60 and below the petal basket 48 moves downwardly in setting operation. When this occurs, the Belleville washers 66 are compressed. Such compression sustains an operative force on a set of slips indicated generally at 70. The slips 70 are located on the outside of the extension tube 60 and move as a unit with the externally located apparatus during setting. In the running condition shown in FIG. 1, the external slips 70 are retracted. Alternate forms of slip construction can be used including inflatable packers and the like. This slip 70 is formed of an external tubular member 71 which abuts the spring housing 67. The member 71 is notched with a circular external groove 72 to localize bending. The slip 70 is formed by lengthwise cuts so that the slip portion 73 is able to deflect outwardly by bending at the groove 72. An internal stress relief groove is located at 74 to enable bending at that location. The segment 75 defines another slip segment or portion connected to the portion 73. In like fashion, another undercut groove at 76 enables easy bending whereby the segment or portion 77 deflects radially outwardly. So to speak, the portions 73, 75 and 77 together form something of a bent U-shaped member which is forced outwardly during telescoping movement. The segment or portion 77 extends to the groove 78 cut at the bottom end of the slip member 71. FIG. 2 shows deflection of individual slip fingers which extend outwardly, each made of similar segments.

The extension tube 60 extends to the very bottom of the apparatus where it supports a bottom guide plug 80. The plug 80 also threads to the extension tube 60. The plug 80 is fixed by a suitable set screw 81. The passage 32 extends to the very bottom of the tool 10, and is opened to the exterior through lateral ports 82. This passage communicates with the well. The plug 80 has an upwardly facing shoulder 83 which supports the sleeve 71 forming the upper end of the slip assembly. The slip assembly is slotted along its length to define several individual fingers below the sleeve 71. This construction enables the slip 70 thereabove to extend radially outwardly and thereby grip the interior surface of the casing. Conveniently, serrations are added at the segment portion 75 to assure conforming gripping action against the casing.

While the foregoing discusses the deployment of the components which make up the TTBP 10, a sequence of operation will be described. Perhaps this will assist to convey understanding of the construction and operation of the device. Recalling that the goal is to set a mixture of sand and cement free of contamination from well fluids, the TTBP is deployed to support the uncured mixture at a specified elevation while bypassing fluid up the passage 32. Suitable ports are included for this flow route.

OPERATION OF THE PREFERRED EMBODIMENT

Assume that the TTBP 10 is run into a well to a desired depth in a cased well. Assume that there are fluids produced therebelow which might otherwise contaminate the uncured plug. Assume that this tool 10 was placed in the well on a typical running tool able to provide relative motion to the sleeves 13 and 15 as will be described. When the TTBP is lowered to the desired depth in a well on a wireline, the setting tool 10 is then operated. On operation, the setting sleeve 15 is jammed downwardly while holding the mandrel 11 at the upper end. The enclosed components are fixed in location relative to the outer components which are forced downwardly by the setting sleeve 15. Relative downward movement of the sleeve 15 is transferred along the full length of that sleeve against the shoulder 53. This downward movement forces all the equipment including the petal basket 4B relatively downwardly around the central tube 42. This downward movement is conveyed by the tubular member 57 through the slip cage 62 and compresses the spring 66. When compressed, it bears against the slip assembly 70. As pressure is applied to the slip assembly 70, the slip fingers deflect radially outwardly bending the segments 73, 75 and 77. Slip fingers are deployed outwardly until they contact and centralize within the surrounding casing as shown in FIG. 2. This movement anchors the device 10 against additional movement in the well. FIG. 2 shows the slips 70 after expansion. the spring elements 66 being compressed. Locking is achieved by operation of the wedge 64 against the tapered slip surface 63 and extension tube 60.

On the downward movement of the exterior parts of the TTBP 10 as described above, a tensile or pulling load is applied to the interior tubes 42 and 60 by means of the mandrel 11. This axial or tensile load is applied while buckling occurs at the slip means 70. Even after setting, the Belleville springs cooperative with the wedge and slip assemblies hold the slip means 70 in the expanded position. Thus, when the setting tool is released the slip means 70 does not release.

A shearing of the shear pins 38 is accomplished by upward pulling on the mandrel 11. When the pull is sufficient, the pins 38 are broken to enable the mandrel 11 to move relatively upward. This movement frees the sleeve 13 for upward movement. At this juncture, the setting tool can be retrieved up the well. The setting tool carries with it the sleeves 13 and 15. The two sleeves simply slide up and disengage the TTBP.

The upward pull from the setting tool pulls the outer sleeve 15 away from the TTBP 10. When this sleeve 15 is pulled upwardly, the slip petals, made of spring metal, are released to deflect outwardly. On release, they deploy to the full diameter of the casing. It will be observed that the sleeve 15 pulls away from the shoulder 53 just below the petal basket 48. As it is pulled up and away from the petal basket, it not only releases the petal basket, but it next releases the centralizer wires 44 to deflect outwardly as shown in FIG. 2. They are deflected outwardly and are held in that position by the coil spring 46 therebelow which assures that the centralizer stays engaged with the surrounding casing. Continued removal of the sleeves 13 and 15 ultimately exposes the fishing neck 16 which is the top end of the TTBP.

The TTBP is anchored in the well with the petal basket deployed. It cannot fall or move because it is held in place by the slips 70 and it is centralized in the casing. Upward flow is permitted through the passage 32. The ports 56 and 55 also introduce fluid to the flow passage 32 in the event the ports 82 become plugged (as may happen if the TTBP tags a muddy bottom of a wellbore. Ports 82 introduce fluid from below to flow upwardly and out through the ports 31 and 33 aligned in FIG. 1. This aligned port arrangement is shown in FIG. 2. Indeed, production of fluid from below the TTBP is occasioned by use of the flow path including the passage 32.

The next step in operation of this equipment is then to deliver a mixture of sand and cement into the petal basket. As will be understood, the tool shown in the drawings is quite long. It extends above the petal basket by several feet. This region is filled with sand and cement above the petal basket extending upwardly short of the slide valve mechanism including the ports 31 and 3S.

The sand and cement is delivered in a suitable quantity to form a plug of adequate length in the casing. Fluid contamination is reduced by provision of the flow path just described. Indeed, the sand and cement is isolated for a period of time, thereby enabling curing whereupon the next sequence of operation is undertaken. Assume that the plug has cured even while fluid flows through the tubing passage 32. When the cure is completed, the next step is undertaken.

Recall at this moment that the top end of the TTBP is the fishing neck 16. An overshot is then run into the well. The overshot is latched to the fishing neck 16. A measured pull is then taken on the overshot. Recall that the bottom portion of the TTBP is now cemented in place. The plug of cement might be easily ten feet in length. Thus, the tubing 42 is well anchored in location. Recall that the tubing 42 connects ultimately with the plug 18. An upward pull on the overshot is applied to the fishing neck 16. Directing attention now to FIG. 2 of the drawings, the pull at the fishing neck 16 is increased whereby the shear pin 28 is sheared. There is some slack in the shear pin connection between the pin 28 and the slot 29. This slack is needed at the time of installation through use of the setting tool. Because of the great length of the tool 10 in typical circumstances, there is some elongation and hence, the shear pin 28 preferably connects with the slot 29 of controlled length. Thus, the shear pin 28 is not sheared during setting. In other words, the pin 28 is not sheared while tension is taken on the internal components and a compressive force is applied to the setting sleeve 15 on the exterior. While the shear pin 28 operates in that fashion at that preliminary step, at the time of engaging the fishing neck 16 with a overshot, sufficient tension is taken so that the shear pin 28 is now broken. When it breaks, it then releases the equipment at the top end of the TTBP for manipulation of the sleeve valve.

Figure 3A:
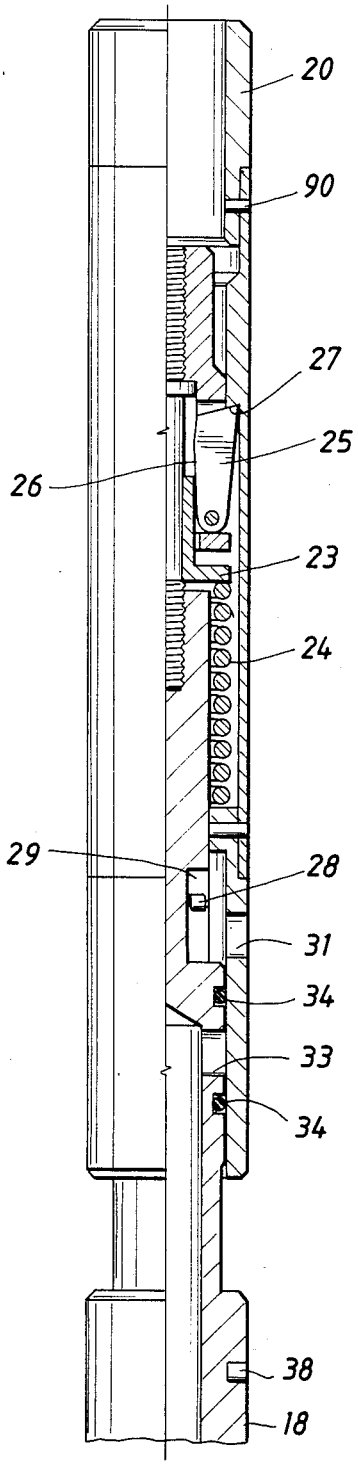
FIGS. 3A–3B are a sectional view through the valve setting apparatus at the upper end of the through tubing bridge plug showing movement of the components after the through tubing flow path has been closed.
Figure 3B:
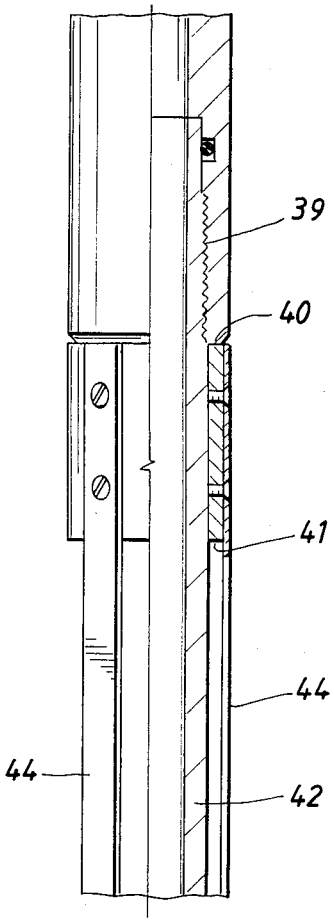

The contrast between FIGS. 2 and 3 will make valve operation more apparent. The shear pin 28 is first broken; then slack is provided in the overshot supportive wireline. Usually, this can be observed at the surface by momentary change in wireline loading. Recall that the dogs 25 are pivoted. After the shear pin 28 has been broken, the fishing neck 16 is free to move upwardly a short distance. When it moves up, the surrounding sleeve 22 is likewise pulled upwardly. Prior to breaking the shear pin 28, the spring 24 was not fully compressed. Additional compression occurs beoause all of the pull from the overshot is delivered to the sleeve 22, further compressing the coil spring 24 to the condition shown in FIG. 3. As the sleeve 22 slides upwardly, the dogs 25 are released and deflect outwardly under urging of the wedge 23 which forces the dogs outwardly to lock against the shoulder 27. Recall that the fishing neck 16 was held in the engaged position by the enlargement 19 at the bottom end of the fishing neck. This condition is sustained so long as the plug 18 is in the "up" position shown in FIG. 1. However, upward sliding movement of the outer sleeve 22 is accompanied by relative downward movement of the plug 18 to a point where it is below the enlargement 19. The enlargement 19 was locked in position in FIG. 1 by the plug 18. When the plug 18 is moved relatively downwardly, it pulls so far down into the tool that the enlargement 19 is then free to deflect, thereby causing the collet fingers to deflect radially inwardly. When this occurs, the tool 10 is then released to thereby permit retrieval of the fishing neck 16 and the affixed collet fingers 17. In other words, the enlargement 19 is no longer locked. This then permits the wireline overshot to be retrieved. Successful operation is indicated at the surface by recovery of the fishing neck 16.

Going now to FIG. 3, the operation just described accomplishes the following movements. The sleeve 22 is locked in the "up" position by the dogs 25 wedging against the shoulder 27. The dogs are held in this position by the wedge 23 on the interior of the dogs. In turn, that holds the sleeve 22 relatively upwardly. This separates the port 31 from the port 33. The slide valve operation blocks the passage 32. The passage 32, now blocked, terminates flow by operation of the seals 34 which flank the passage 33. Flow through the TTBP is now plugged. Recall that this flow path was kept open during the plug curing process. It can now be closed permanently. At this juncture, additional sand and cement can be introduced on the top of the cement plug already in place to a depth so that the TTBP is completely covered over. This second batch of curable materials completely covers over the slide valve mechanism isolated in FIG. 3 and assures that the plug is substantially able to hold in the casing. This completely isolates the cased well below the plug. At this juncture, the bridge plug 10 has accomplished its purpose, thereby now completely anchoring a concrete plug in location.

While the foregoing is directed to the preferred embodiment of the through tubing bridge plug as described in detail, the scope will be determined by the claims which follow.

What is claimed is:

1. A method of placing a concrete plug in a cased well located so that well fluids are blocked by the plug and where such well fluids interfere with curing of the concrete plug, the method comprising the steps of:

(a) running into the cased well an elongate bridge plug assembly having an upwardly facing basket with a retracted position and expanded position for adapted to receive and hold curable material for forming a concrete plug;

(b) setting the bridge plug assembly at a desired depth in the cased well by expanding a slip means to support the bridge plug assembly;

(c) operating the bridge plug assembly basket to an expanded position;

(d) placing curable materials in the upwardly facing basket and curing the materials to form concrete;

(e) during curing, forming a well fluid flow path across the bridge plug assembly from below to above the basket, the flow path utilizing an upstanding flow pipe selectively opened and closed by a valve means at the upper end thereof;

(f) defining the valve means by a movable member and fixed member comprising a portion of said flow path;

(g) during curing of the curable materials to form concrete, opening the valve means to enable fluid flow along the flow path; and (h) after curing, closing the valve means to prevent fluid flow along the flow path, thereby completely plugging the cased well wherein the step of closing the valve means includes pulling upwardly on the movable member such that upward pull moves the movable member upwardly to close the flow path.

2. The method of claim 1 including the subsequent steps of placing additional curable material to increase the extent of plug in the cased well, and curing the additional materials.

3. The method of claim 2 wherein the bridge plug assembly supports the upstanding flow pipe above the basket and wherein the additional curable material covers the upstanding flow pipe.

4. The method of claim 3 wherein the upstanding flow pipe supports the valve means at the upper end thereof, and including the steps of opening or closing the valve means as recited at steps (f) and (h) of claim 1 by wireline manipulation of wireline supported tools above the bridge plug assembly.

5. The method of claim 4 wherein the fixed and movable members of the valve means include a slide valve inner and outer concentric sleeves having aligned ports for closure of the valve means, and also include an upstanding fishing neck releasably connected to said outer sleeve for retrieval on closure of the valve means by moving said outer sleeve upwardly, and including the step of engaging and retrieving the fishing neck to obtain a surface indication that the valve means was closed.

6. The method of claim 1 wherein the upwardly facing basket and the slip means are supported on the bridge plug assembly by an external telescoping tubular member positioned about an internal tubular member, and wherein said slip means is radially expanded by applying relative motion to said external and internal tubular members of the bridge plug assembly.

7. The method of claim 6 including lock means between said external and internal tubular members for holding the slip means in the radially expanded position, and further including the step of forcing the external tubular member axially downwardly relative to the internal tubular member until said lock means is operated to hold the slip means in an expanded position.

8. The method of claim 7 including centralizer means on the bridge plug assembly formed of a plurality of centralizing elements extendable radially outwardly, and including the step of deploying said centralizer means to an expanded radially outwardly extending position by movement of the external and internal tubular members.

9. The method of claim 1 wherein the bridge plug assembly includes spaced slip means, the upwardly facing basket, and centralizer means on said bridge plug assembly, and including the steps of utilizing a running tool to set the slip means, expand the upwardly facing basket, and deploy the centralizer means.

10. The method of claim 9 including selectively opening and closing slide valve means on the bridge plug assembly wherein the slide valve means are opened on deployment of the upwardly facing basket in the cased well, and including the steps of bailing sand and cement into the basket as the curable materials in the basket to form the plug, and further including the step of operating the slide valve means extending above the cured material, the slide valve means being opened and closed selectively to permit or block fluid flow past the cured plug.

11. The method of claim 1 including a removable sleeve adapted to be supported on a running tool, said sleeve being secured to the bridge plug assembly by means of a shear pin and wherein said sleeve extends over centralizing means on the bridge plug assembly from the top of the bridge plug assembly, and including the method steps of utilizing the running tool to locate the bridge plug assembly at a specified depth in a cased well followed by the steps of shearing the shear pin and thereafter pulling the sleeve from the bridge plug assembly.

12. The method of claim 11 including a second sleeve covering the upper end of the bridge plug assembly, and including the step of placing a fishing neck in the second sleeve prior to running in a well, then removing the second sleeve to expose the fishing neck.

13. The method of claim 12 including the step of placing the fishing neck in a position to lock open a valve, and thereafter pulling the fishing neck to release the valve from the locked open position.

14. The method of claim 13 wherein the fishing neck is releasably connected to the valve, and including the step of applying a resilient means to the valve to close the valve after the fishing neck is pulled to release the valve.

15. A bridge plug assembly adapted to be placed in a cased well to isolate and controllably block fluid flow thereacross, the assembly comprising:

(a) an elongate flow pipe:

(b) valve means at the top end of said flow pipe;

(c) slip means supported by said flow pipe for expansion to engage a surrounding well casing;

(d) upwardly facing basket means supported by said flow pipe having:

(1) a closed and collapsed position around said flow pipe; and (2) an expanded position facing upwardly to receive curable materials therein;

(e) said flow pipe and said valve means defining a flow path from below said basket means to above said basket means wherein said valve means opens or closes the flow path;

(f) first and second co-acting means supported by said flow pipe for telescoping movement therebetween for (1) expanding said slip means to engage the well casing;

(2) expanding said basket means; and (3) opening said valve means; and (g) first and second concentric sleeves having ports formed therein to define a flow path through said valve means, said valve means further including seals cooperative with said concentric sleeves, and also including a passage along said flow pipe to connect with the ports in said concentric sleeves and one of said concentric sleeves is pulled upwardly to close said ports in closing said valve means.

16. The apparatus of claim 15 further including a shear pin securing said first and second concentric sleeves in a fixed position during tool running, and further including a removable sleeve around said valve means.

17. The apparatus of claim 15 further including a supportive collar anchoring said basket means around said flow pipe; and a protruding locking pin on said collar extending into an encircling groove means in said collar to enable rotation of said collar and said basket means.

* * * * *